US006023246A

United States Patent [19]

Tanabe

[11] Patent Number: 6,023,246

[45] Date of Patent: Feb. 8, 2000

[54] LENS ANTENNA WITH TAPERED HORN AND DIELECTRIC LENS IN HORN APERTURE

[75] Inventor: Kosuke Tanabe, Tokyo, Japan

[73] Assignee: NEC Corporation, Tokyo, Japan

[21] Appl. No.: 09/055,928

[22] Filed: Apr. 7, 1998

[30] Foreign Application Priority Data

Apr. 9, 1997 [JP] Japan ..... 9-090824

[51] Int. Cl.[7] ..... H01Q 19/06; H01Q 13/00

[52] U.S. Cl. ..... 343/753; 343/786

[58] Field of Search ..... 343/753, 786, 343/909

[56] References Cited

U.S. PATENT DOCUMENTS

| | | | |
|---|---|---|---|
| 4,065,772 | 12/1977 | Seavey | 343/786 |
| 4,349,827 | 9/1982 | Bixler et al. | 343/786 |
| 4,410,892 | 10/1983 | Knop et al. | 343/786 |
| 4,788,553 | 11/1988 | Phillips | 343/753 |
| 5,117,240 | 5/1992 | Anderson et al. | 343/753 |
| 5,317,328 | 5/1994 | Allen | 343/786 |

FOREIGN PATENT DOCUMENTS

| | | |
|---|---|---|
| 0 066 455 | 12/1982 | European Pat. Off. . |
| 58-219802 | 12/1983 | Japan . |
| WO 89/06446 | 7/1989 | WIPO . |

OTHER PUBLICATIONS

George D. M. Peeler, "Lens Antennas", pp. 16–1 through 16–11.

*Primary Examiner*—David H. Vu
*Assistant Examiner*—Tan Ho
*Attorney, Agent, or Firm*—Young & Thompson

[57] ABSTRACT

A lens antenna having high antenna efficiency, low sidelobe levels, and that is easily assembled. The lens antenna includes a first horn made of a metallic conductor, a second horn made of a high-frequency absorbing plastic material, and a lens for controlling the power distribution at an aperature of the horn. Screws may be used to assemble the first horn, the second horn, and the lens. Though some of the microwave signals input through the circular waveguide of the first horn are reflected on the surface of the lens, most of the microwave signals are absorbed by the second horn. Moreover, because no wave absorber is bonded to an inner wall of a conical horn, nothing screens the microwave signal, the power density distribution at the aperture of the lens is not disrupted. Therefore, it is possible to obtain a desired power density distribution.

16 Claims, 6 Drawing Sheets

LENS ANTENNA WITH TAPERED HORN AND DIELECTRIC LENS IN HORN APERTURE

BACKGROUND OF THE INVENTION

1. Field of the Invention

The present invention relates to a lens antenna, particularly to the lens antenna for transmitting/receiving microwave band signals or millimeter-wave band signals and to a method of controlling sidelobe levels.

2. Description of the Related Art

In a conventional lens antenna, a dielectric circular lens is set in an aperture of a horn antenna for the microwave band signals or the millimeter-wave band signals to improve antenna efficiency as disclosed in the official gazette of Japanese Patent Laid-Open No. 219802/1983.

In FIG. 6, symbol 30 denotes a conical horn, 34 denotes a lens, 36 denotes a screw, and 37 denotes a wave absorber. The dielectric lens 34 is circular and is set in the aperture of the metallic conical horn 30. Moreover, in this conventional lens antenna, the wave absorber 37 is bonded to an inner wall of the conical horn 30 with an adhesive to reduce the sidelobe level of the radiation pattern of the lens antenna.

The first problem of the conventional lens antenna lies in the fact that the reflections of high-frequency signals on the lens surface degrade the radiation pattern and antenna efficiency. This is because reflections of high-frequency signals on the lens surface repeat multiple reflections between a surface of the lens and the inner wall of the horn to disturb the power distribution of the high-frequency at the aperture of the lens.

The second problem lies in the fact that, when the wave absorber to the inner wall of the horn is bonded to reduce the sidelobe level of the radiation pattern, high-frequency signals are screened by the wave absorber and antenna efficiency is degraded.

The third problem lies in the fact that the bonding of the wave absorber onto the curved surface of the inner wall of the horn with an adhesive is difficult and reduces productivity.

SUMMARY OF THE INVENTION

In view of the above problems, it is an object of the present invention to provide a lens antenna having high antenna efficiency and controllable sidelobe level characteristics.

It is another object of the present invention to provide a lens antenna that is easily assembled and has high productivity.

The lens antenna of the present invention comprises a tapered horn and a dielectric lens set in the aperture at a flared-side front end of the horn, in which a part of the horn is made of a high-frequency absorbing material. Moreover, it is preferable that the outside of the part made of a wave absorber of the horn is plated with metal.

In another aspect of the present invention, it is preferable that it is the tapered part of the horn that is made of the high-frequency absorbing material. Moreover, it is preferable that the outside of the tapered part made of the wave absorber of the horn is plated with a metal.

The tapered part of the horn can be conical or quadrangular pyramidal.

In the lens antenna of the present invention, the horn is formed by replacing a part of the conical part of the horn with a plastic material that absorbs radio-waves. Thereby, multiple reflections in the horn are reduced and a high-frequency signal in the horn is not screened.

Some high-frequency signals applied through the circular waveguide of the horn are reflected on the surface of the lens and absorbed by a part of the horn having the high-frequency absorbing function. Moreover, because no wave absorber is bonded to the inner wall of the horn, nothing screens the high-frequency power or disrupts the power density distribution at the aperture of the lens antenna. Therefore, because the power density distribution at the aperture of the lens antenna is not disturbed or influenced due to reflected signals, a desired power density distribution is obtained.

DETAILED DESCRIPTION OF PREFERRED EMBODIMENTS OF THE INVENTION

Figure 1:
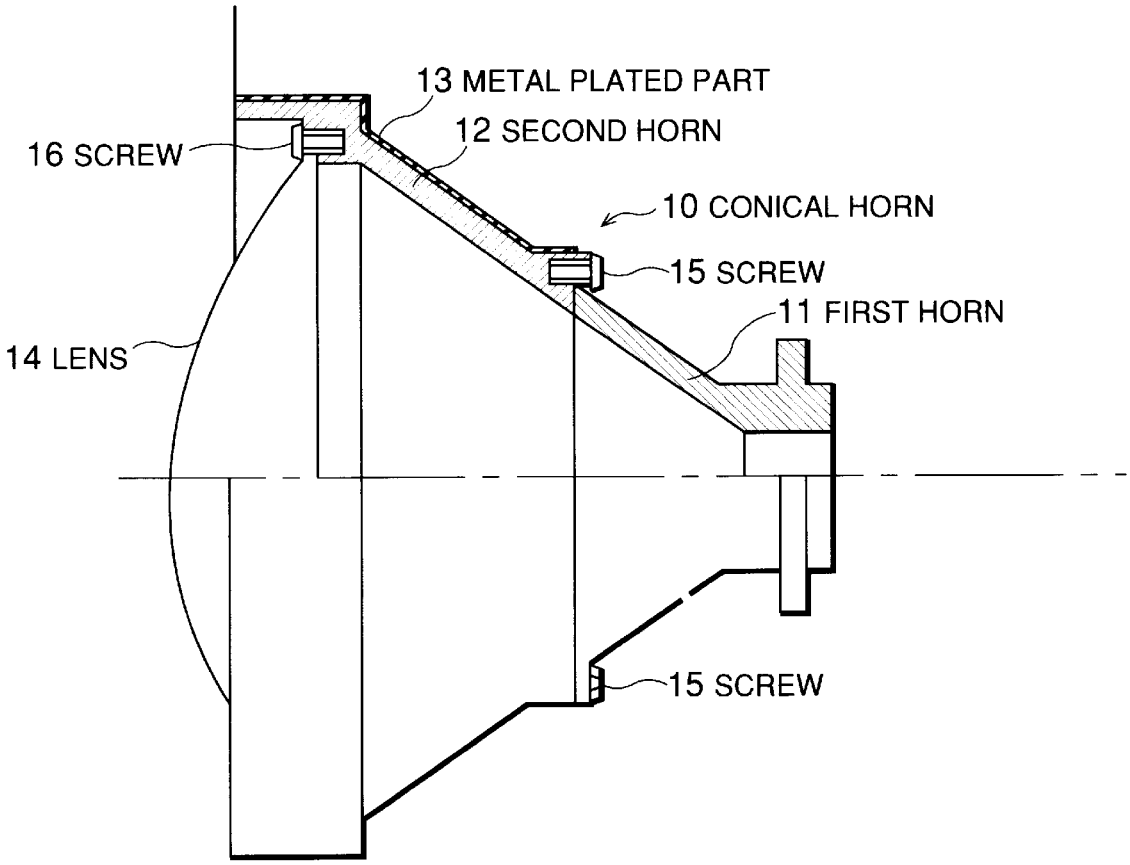
FIG. 1 is a local sectional side view of the lens antenna of a first embodiment of the present invention.

With reference now to FIG. 1, the lens antenna of the first embodiment of the present invention comprises a conical horn 10 that includes a first horn 11 having a circular waveguide made of a metallic conductor and a second horn 12 having a high-frequency absorbing function, a circular lens 14 for controlling the power distribution at the aperture of the second horn 12, and screws 15 and 16 for assembling the first horn 11, the second horn 12, and the lens 14.

The first horn 11 is desirably conical, and one end forms a circular waveguide for inputting high-frequency signals. The other end of first horn 11 has a flange structure for connecting the second horn 12. First horn 11 may be made of aluminum. The second horn 12 forms an extension of the first horn 11, and has one flanged end for connecting the first horn 11 and a second flanged end for connecting the lens 14. Second horn 12 may be made of a plastic material formed by adding a proper amount of carbon to polycarbonate resin and which has a high-frequency absorbing function. Moreover, the outside of the second horn 12 may be plated with a metal to improve the high-frequency absorbing function and prevent high-frequency signals from leaking out of the horn 12. The first horn 11 and second horn 12 are fixed by the screw 15 to form one conical horn 10. The lens 14 is made of polycarbonate resin, located at the aperture of the conical horn 10, and fixed by the screw 16.

Figure 2:
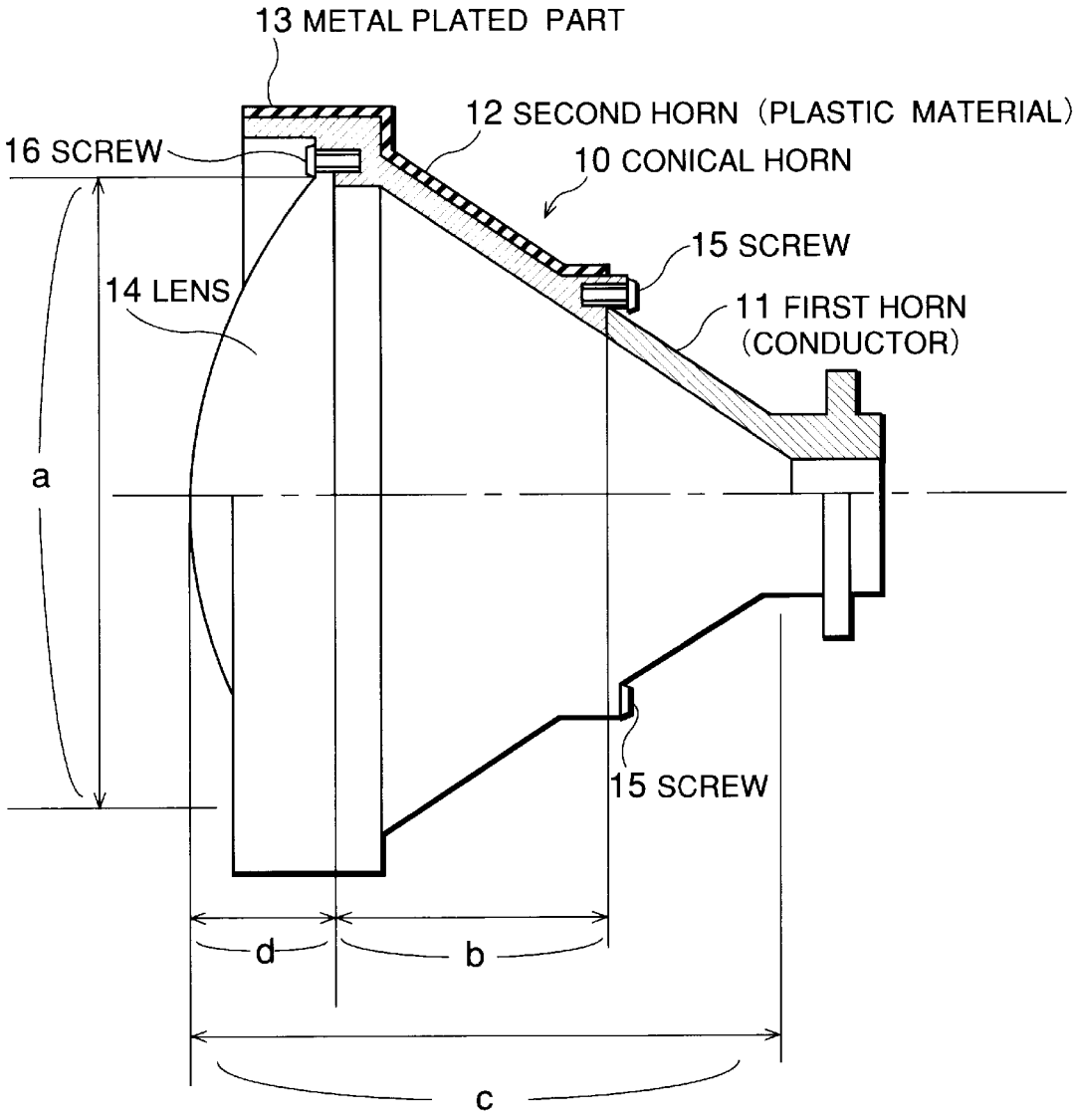
FIG. 2 is a local sectional side view showing detailed sizes of the lens antenna shown in FIG. 1.

With reference to FIG. 2, the effective diameter a of the aperture of the conical horn 10 is desirably about 27λ (λ is wavelength of an operating frequency). The conical part of the second horn 12 has an axial length b that is desirably about 14λ. The axial length c of the lens antenna is desirably about 29λ. The axial length d of the lens 14 is desirably about 6λ.

For example, sizes of the lens antenna for a transmission frequency ft=38 GHz may be as follows. An effective diameter a of the aperature of the conical horn 10 is 300 mm. The axial length b of second horn 12 is 156 mm. The axial length c of the lens antenna is 327 mm. The thickness d of the lens 14 is 67 mm.

Figure 3:
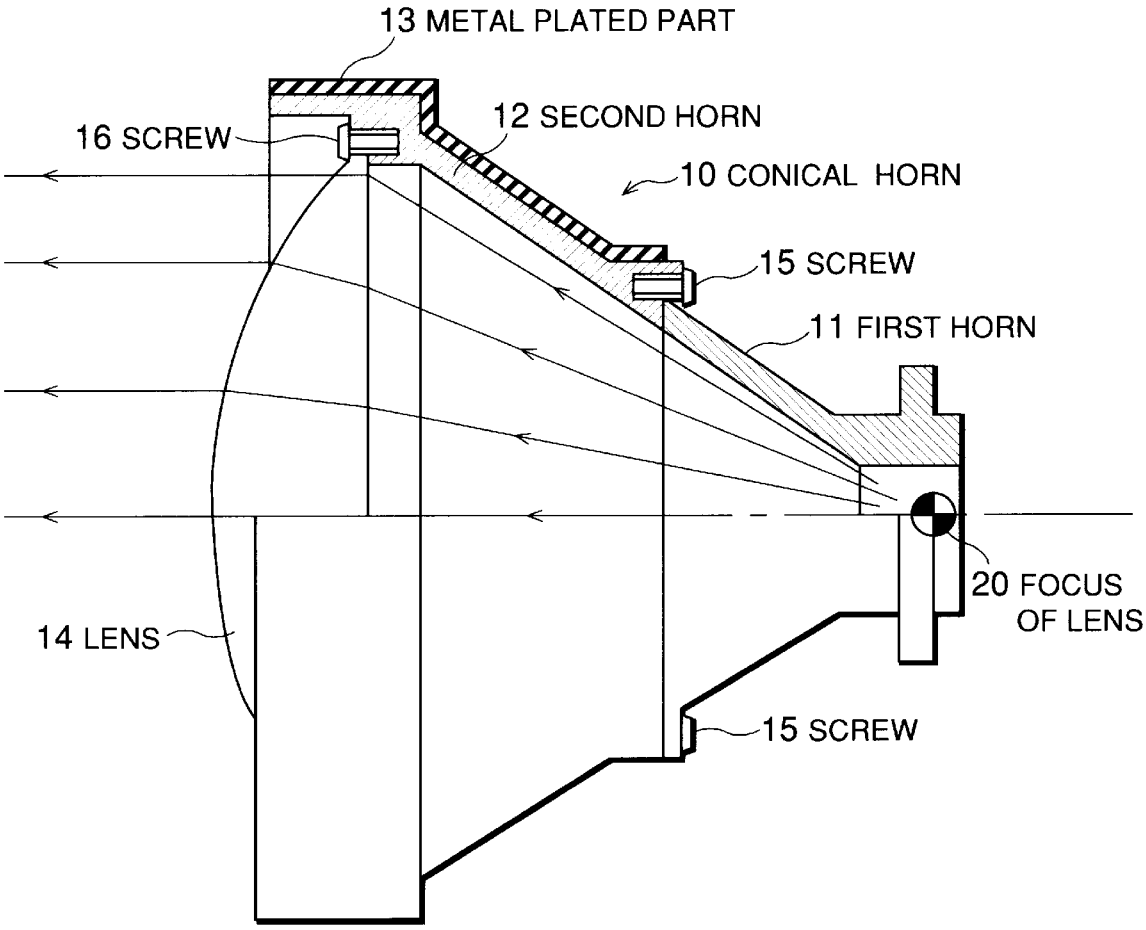
FIG. 3 is a ray trace of the lens antenna shown in FIG. 1.

Operation of the first embodiment of the present invention is described below in detail with reference to FIGS. 1 and 3. The high-frequency signals input through the circular waveguide of the first horn 11 are transmitted through the inside of the conical horn 10 from a focus 20 of the lens 14 and reach the lens 14. Some of the high-frequency signals reaching the lens 14 pass through the lens 14 and show a power distribution having desired amplitude and phase at the aperature of the lens 14. Some of remaining high-frequency signals reaching the lens 14 are reflected on the surface of the lens 14 and transmitted through the inside of the conical horn 10 in the opposite direction. Most of the high-frequency signals reflected on the lens 14 are absorbed by the second horn 12 made of the high-frequency absorbing plastic material and some of the signals passing through the second horn 12 are reflected by the metal plated part 13 on the outside. That is, because most of the high-frequency signals reflected on the lens 14 are absorbed by the second horn 12, the power reflected on the inner wall of the conical horn 10 and reaching the lens 14 again are very small compared to the power directly reaching the lens 14 through the circular waveguide of the first horn 11. Therefore, the power density at the aperture of the lens formed primarily with the power input through the circular waveguide of the first horn 11 and directly reaching the outside of the lens 14 without reflection on the surface of the lens 14. This provides the desired power density distribution. The performance of a lens antenna having a high antenna efficiency and a low sidelobe level can be achieved by the desired power density distribution.

In a further embodiment, the size of the first horn 11 is reduced so that substantially all of the tapered part has the high-frequency absorbing function.

Moreover, the first embodiment is described with a structure in which the outside of the second horn 12 is metal plated. However, many of the advantages of the present invention can be obtained without the metal plating.

Furthermore, the first embodiment includes a conical horn. The same advantage is obtained even when a horn has a quadrangular pyramidal shape or other suitable shape.

Figure 4:
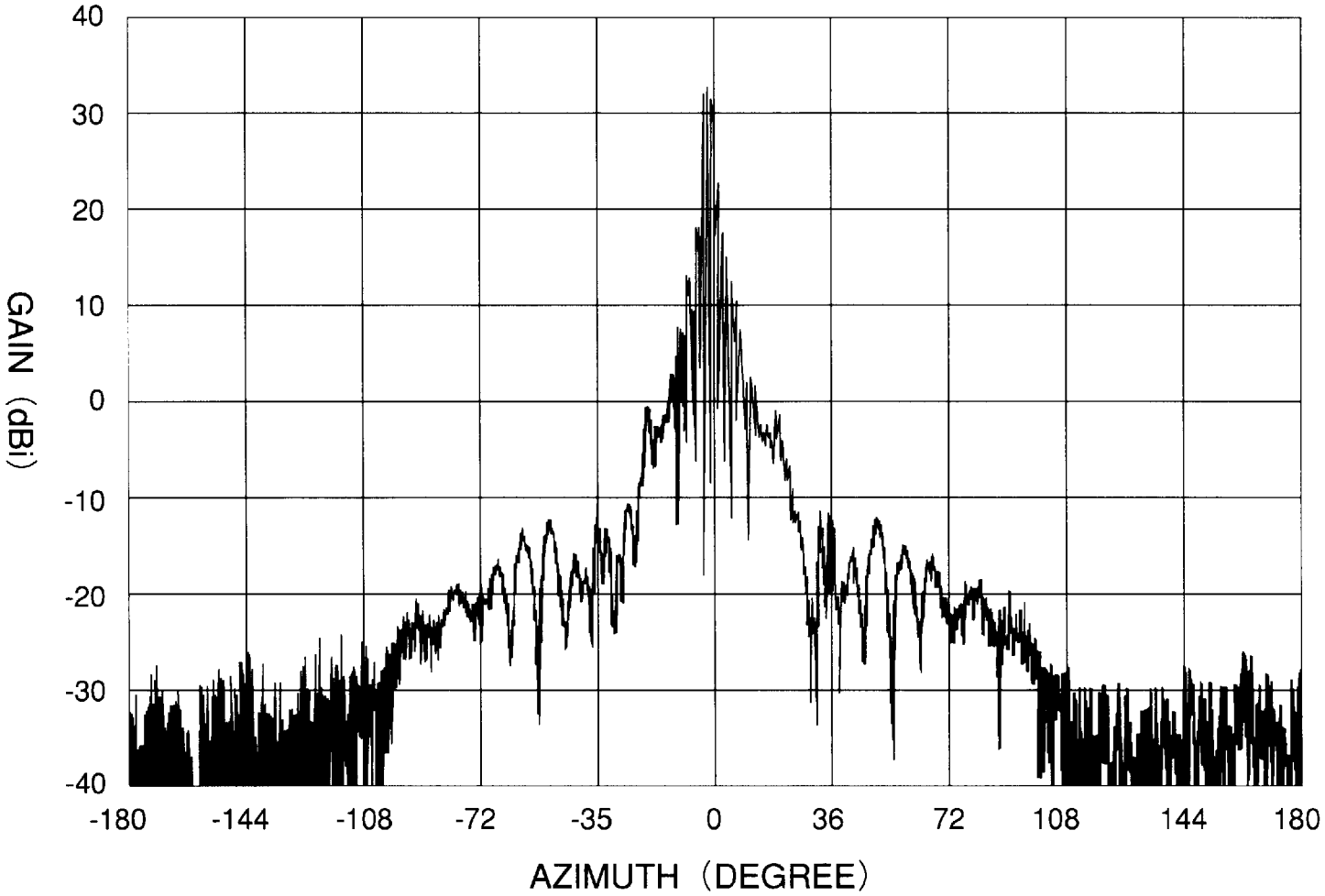
FIG. 4 is a graph showing the radiation pattern of the lens antenna of the embodiment in FIG. 1.

FIG. 4 is a graph showing the radiation pattern of the lens antenna of this embodiment. FIG. 4 shows that the lens antenna has high directivity and low sidelobe characteristics.

Figure 5:
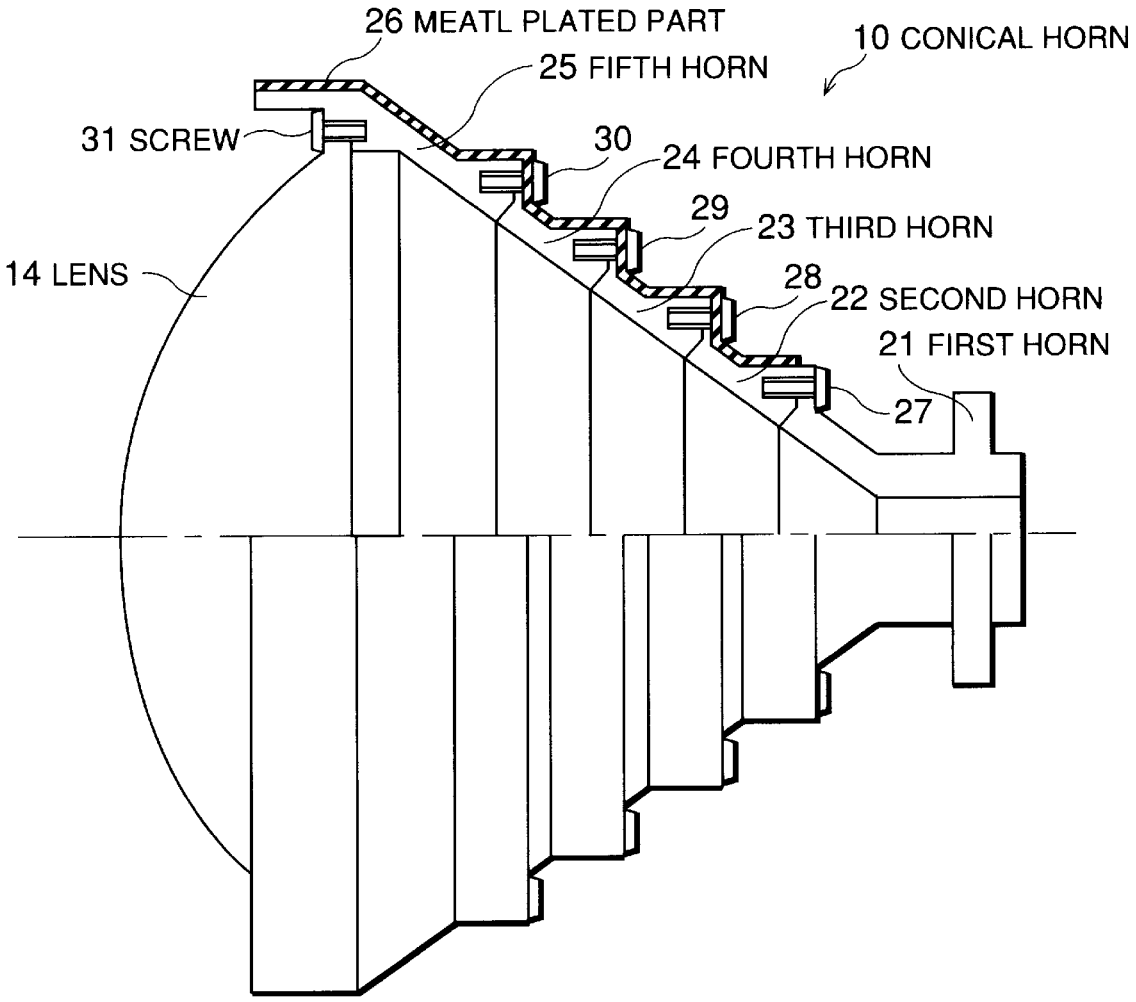
FIG. 5 is a local sectional side view showing a second embodiment of the present invention.
Figure 6:
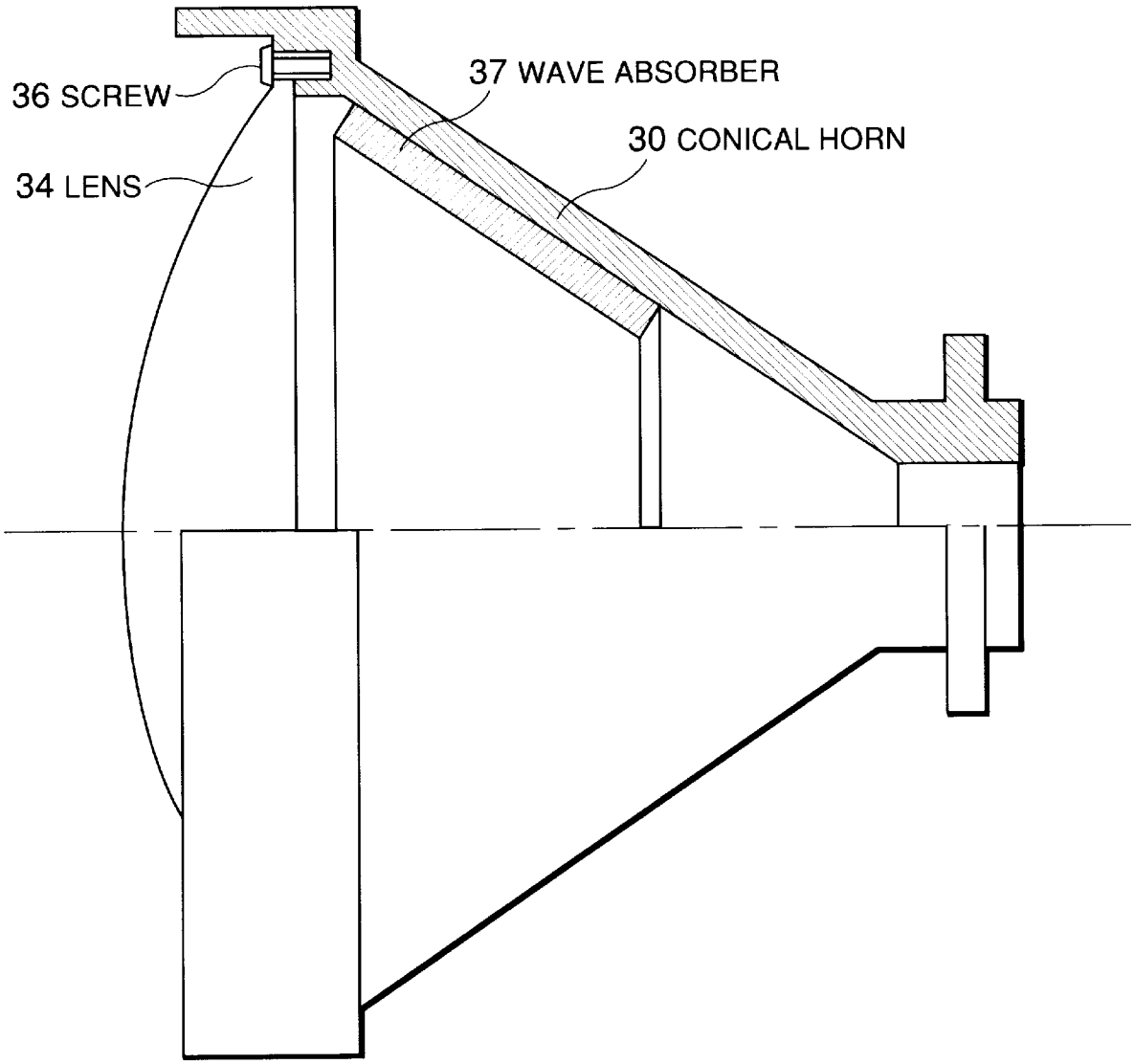
Figure.6 (PRIOR ART)
FIG. 6 is a local sectional side view showing a conventional lens antenna.

FIG. 5 shows a configuration of a further embodiment of the present invention in which the sidelobe levels are controllable. The lens antenna of the further embodiment has a plurality of divided conical horns which are made of radio-wave absorbing material or metal.

In FIG. 5, the lens antenna comprises five-divided conical horns 21 to 25 and the lens 14. That is, a first horn 21 is conical, whose one end forms the circular waveguide.

Subsequent horns 22–25 are extensions of the cone of the first horn 21 and are connected to each other by using the screws 27–30. Outside of one or more of horns 22 to 25 may be provided with the metal plates 26. Horns 22 to 25 may be made of plastic material having the high-frequency absorbing material or metal.

Materials of horns 22 to 25 are selected according to the required sidelobe level characteristics. When materials of the horns are high-frequency absorbing material, the lens antenna has low sidelobe levels and low transmission levels. On the other hand, when materials of the horns are metal, the lens antenna has high sidelobe levels and high transmission levels. That is, there is tradeoff between the sidelobe level and the transmission level.

For example, when severe sidelobe level characteristics are required, the high-frequency absorbing material is selected to lower the sidelobe level. On the other hand, when rough sidelobe level characteristics are required, the metal material is selected in order to increase the transmission level.

Moreover, when precise characteristics of the sidelobe level and the transmission level are required, the number of divided horns is increased. On the other hand, when coarse characteristics of the sidelobe level and the transmission level are required, the number of divided horns is decreased.

The further embodiment has the advantage of adjusting the number and materials of the divided horn according to required sidelobe level characteristics. Therefore, the most adequate number and materials of each of the divided horns can be selected according to the required sidelobe level in consideration of the tradeoff between low sidelobe characteristics and high transmitted power characteristics.

In the above description, the present invention has the first advantage that the sidelobe level of the radiation pattern is low. This is because multiple reflections of the high-frequency signal between the surface of the lens and the inner wall of the horn are reduced and thereby, a desired distribution can be obtained without disturbing the power density distribution at the aperture of the lens antenna. A second advantage is that the antenna efficiency is high. This is because no wave absorber is bonded to the inner wall of a horn and therefore, nothing screens high-frequency signal passing through the inside of the horn. A third advantage is that assembling is easy and the productivity is high. This is because a small number of parts are used and all the parts used are fixed only by screws.

What is claimed is:

1. A lens antenna for transmitting/receiving microwave band signals or millimeter-wave band signals comprising:

an antenna comprising, a first tapered horn made of a metallic conductor, and a second tapered horn that is an extension of said first tapered horn and that is made of a high-frequency absorbing material; and a dielectric lens in an aperture of said second tapered horn opposite said first tapered horn.

2. The lens antenna according to claim 1, wherein an outside of said second tapered horn is plated with a metal.

3. The lens antenna according to claim 1, further comprising a circular waveguide at one end of said first tapered horn opposite said second tapered horn.

4. The lens antenna according to claim 1, further comprising screws for attaching said first tapered horn and said dielectric lens to said second tapered horn.

5. The lens antenna according to claim 1, wherein said dielectric lens comprises a polycarbonate resin.

6. The lens antenna according to claim 1, wherein said second tapered horn comprises a plastic material obtained by adding a proper amount of carbon to polycarbonate resin.

7. The lens antenna according to claim 1, wherein said second tapered horn is one of a conical shape and a quadrangular pyramidal shape.

8. A lens antenna for transmitting/receiving microwave band signals or millimeter-wave band signals comprising;

a tapered horn made of a metallic conductor;

a plurality of tapered divided horns each comprising one of a high-frequency absorbing material and metal and that are extensions of said tapered horn; and a dielectric lens in an aperture of said tapered divided horns opposite said tapered horn.

9. The lens antenna according to claim 8, wherein an outside of at least one of said tapered divided horns is plated with metal.

10. The lens antenna according to claim 8, further comprising screws for attaching said tapered horn, said divided horns and said dielectric lens to each other.

11. The lens antenna according to claim 8, wherein said dielectric lens comprises a polycarbonate resin.

12. The lens antenna according to claim 8, further comprising a circular waveguide at one end of said tapered horn opposite said divided horns.

13. The lens antenna according to claim 8, wherein said tapered horn and said tapered divided horns are one of a conical shape and a quadrangular pyramidal shape.

14. A lens antenna for transmitting/receiving microwave band signals or millimeter-wave band signals comprising:

a tapered horn; and a dielectric lens in an aperture of said tapered horn;

wherein substantially all of said tapered horn is made of a high-frequency absorbing material.

15. The lens antenna according to claim 14, wherein an outside of said tapered horn is plated with a metal.

16. A method of controlling sidelobe levels in a lens antenna having a plurality of tapered divided horns made of a high-frequency absorbing material, the method comprising the step of:

selecting the number of the tapered divided horns based on the required sidelobe levels.

* * * * *

UNITED STATES PATENT AND TRADEMARK OFFICE

CERTIFICATE OF CORRECTION

PATENT NO. : 6,023,246
DATED : February 8, 2000
INVENTOR(S) : Kosuke Tanabe

It is certified that error appears in the above-identified patent and that said Letters Patent is hereby corrected as shown below:

Title page,
Item [56], References Cited, insert the following foreign references:

| | | |
|---|---|---|
| 7-25609 | 5/1995 | Japan |
| 53-48544 | 9/1951 | Japan |
| 56-69903 | 6/1981 | Japan |
| 58-219802 | 12/1983 | Japan |
| 60-30617 | 3/1985 | Japan |
| 60-157303 | 8/1985 | Japan |
| 61-75614 | 5/1986 | Japan |

Signed and Sealed this

Twenty-first Day of August, 2001

*Attest:*

Nicholas P. Godici

*Attesting Officer*

NICHOLAS P. GODICI
*Acting Director of the United States Patent and Trademark Office*